United States Patent [19]

Meitner et al.

[11] 4,328,279

[45] May 4, 1982

[54] CLEAN ROOM WIPER

[75] Inventors: Gary H. Meitner; Stephen M. Englebert, both of Winnebago County, Wis.

[73] Assignee: Kimberly-Clark Corporation, Neenah, Wis.

[21] Appl. No.: 230,016

[22] Filed: Jan. 29, 1981

[51] Int. Cl.[3] ..... D04H 1/58

[52] U.S. Cl. ..... 428/289; 252/91; 252/353; 252/354; 252/557; 428/195; 428/219; 428/297; 428/302; 428/903

[58] Field of Search ..... 252/91, 353, 354, 557; 428/195, 288, 289, 903, 297, 302, 219

[56] References Cited

U.S. PATENT DOCUMENTS 3,959,421 5/1976 Wiber et al. ..... 264/6

4,041,203 8/1977 Brock et al. ..... 428/903

*Primary Examiner*—James J. Bell

*Attorney, Agent, or Firm*—William D. Herrick; Howard Olevsky; W. K. Fredericks

[57] ABSTRACT

Improved low linting, low sodium ion content, wettable nonwoven wiper is provided through the use of a treatment involving a mixture of wetting agents. The wiper of the invention maintains the excellent wiping and low linting characteristics of nonwoven wipers while greatly reducing the amount of sodium ions present in the wiper and avoiding contamination problems especially prevalent in wipe applications for the electronics industry. Specifically, the combined wetting agent treatment includes a mixture of sodium dioctyl sulfosuccinate such as Aerosol OT and a nonionic surfactant such as alkyl phenoxy ethanol (Triton X-100). The preferred mixtures are about 25 to 75% sodium dioctyl sulfosuccinate with a ratio of about 40 to 60 preferred and about 50/50 especially preferred. The result is a wiper having essentially the desired wettability of those made with 100% sodium dioctyl sulfosuccinate wetting agent and yet having only about half the sodium ion content. The wiper, therefore, can be employed advantageously in clean room applications such as the manufacture of micro-electronic devices where the prsence of greater amounts of sodium ions can be very detrimental due to changes of electrical properties of the semiconductor devices. Substrates for the wiper may include various synthetic filamentary material such as polyolefins, including polyethylene and polypropylene, and others which will be apparent to those skilled in the art.

12 Claims, 13 Drawing Figures

CLEAN ROOM WIPER

BACKGROUND OF THE INVENTION

1. Field of the Invention

Improvements in the manufacturing of high technology items such as micro-electronic devices have necessitated the maintenance of essentially a clean room atmosphere. These devices are, in essence, micro processors, the equivalent of the central processing unit of a small computer. They are manufactured using "wafers", thin slices of silicone on which circuits have been fabricated. The integrated circuits accomplish the separation and interconnection of transistors and other circuit elements electrically. The circuit elements are interconnected by a conducting film of evaporated metal that is photoengraved to leave the appropriate pattern of connections. An insulating layer is required to separate the underlying semiconductor from the metal film except where contact is desired. This insulating layer is formed on the surface of the wafer after the wafer has been processed and before the conducting metal is evaporated on it. Contamination, even by bits of lint or dust can bridge these circuits and cause such devices to be defective and is a major source of rejection. Therefore, there is a need to maintain all surfaces and workpieces as free from such contamination as possible. This is usually accomplished in part by wiping these surfaces, and a number of specialized wipers have been developed for this purpose. However, it is critical that the wiper, itself, in addition to being able to wipe cleanly, not contribute to the problem of dusting or linting. Conventional cloth wipes and tissue wipes, accordingly, are not entirely satisfactory. Various nonwoven wipes are also available, but while some are low linting, these require treatment for wettability in order to provide the absorbency and clean wiping characteristics desired for these applications. Such treatments have been most effective utilizing an anionic wetting agent such as Aerosol OT which is high in sodium ion content. These metallic ions present special problems since, if present in high enough concentrations, they may change the electrical properties of metal oxide semiconductors making the devices defective. Accordingly, such wipers have also not been entirely satisfactory. A need, therefore, has been demonstrated for a low linting, clean wiping wiper low in metallic ion content for these specialty applications and for other applications as well.

2. Description of the Prior Art

As stated above, nonwoven disposable and limited use wipers are well-known. Any of a number of nonwoven processes can be used to form base materials for wipers. For example, nonwovens formed by meltblowing, spinning, carding, and fibrillating techniques have been utilized. When formed from synthetic thermoplastic filaments, such materials are normally hydrophobic and non-wettable. For most applications, therefore, it is necessary to treat the nonwoven to make it wettable. A wide variety of anionic and nonionic wetting agents has been developed for this purpose and are in use. Among these, sodium dioctyl sulfosuccinate, such as Aerosol OT, has become a highly preferred agent as providing rapid wettability. For less demanding applications, other wetting agents such as those identified below have been used.

For clean room applications such nonwoven wipers have not proven entirely satisfactory because the treatments for wettability have required a compromise between wetting characteristics produced by Aerosol OT and the need for low metallic ion content. Other specialty wipers have been developed for these applications. For example, woven textile wipers have been used but are expensive and linty. Long fibered, wetlaid cellulose wipers tend also to be linty and of low absorbency and bulk.

Representative descriptions of the prior art products and materials include U.S. Pat. No. 3,811,957 dated May 21, 1974 to Buntin which describes meltblown materials and wettability treatments, U.S. Pat. No. 2,999,265 dated Sept. 12, 1961 to Duane et al. directed to a cleansing and deodorizing pad having a surface active agent treatment, U.S. Pat. No. 3,520,016 dated Oct. 9, 1968 to Meitner describing a cellulosic wipe, U.S. Pat. No. 3,954,642 and 3,956,155 dated May 4 and May 11 1976, respectively, to Schwuger describing textile wipes, and U.S. Pat. No. 3,978,185 dated Aug. 31, 1976 to Buntin et al describing a meltblown material useful as a wiper.

SUMMARY

The present invention is directed to a highly effective, low linting nonwoven wiper having a low sodium ion content for disposable or limited use applications. In order to achieve desired wiping properties for nonwoven wipers made from hydrophobic thermoplastic synthetic fibers, such materials must be treated with a surfactant to obtain wettability with aqueous materials. While it is known to treat such nonwoven materials with surfactants, including sodium dioctyl sulfosuccinate such as Aerosol OT, such treatments increase the metallic ion content of the wiper. For many applications this is acceptable. However, for clean room applications as necessitated in the manufacture of micro-electronic devices mentioned above, and the like, high metallic ion content wipers cannot be tolerated. In such cases treatment with other surfactants has been necessary which, although reducing the level of metallic ion content within acceptable limits, significantly adversely affects wiping properties. In accordance with the present invention, it has been found that treatment of such nonwoven materials with a specific mixture of surfactants including sodium dioctyl sulfosuccinate and a nonionic surfactant such as Triton X-100 (alkyl phenoxy ethanol) reduces the metallic ion content of the wiper to within acceptable limits and yet maintains or even improves the highly effective wiping characteristics obtained through the use of a sodium dioctyl sulfosuccinate surfactant, alone. Thus, the wiper of the invention provides, especially for micro-electronics manufacturing clean room applications, a product possessing the low lint, effective wiping, and low metallic ion content properties essential to these operations.

DESCRIPTION OF THE PREFERRED EMBODIMENTS

Figure 1:
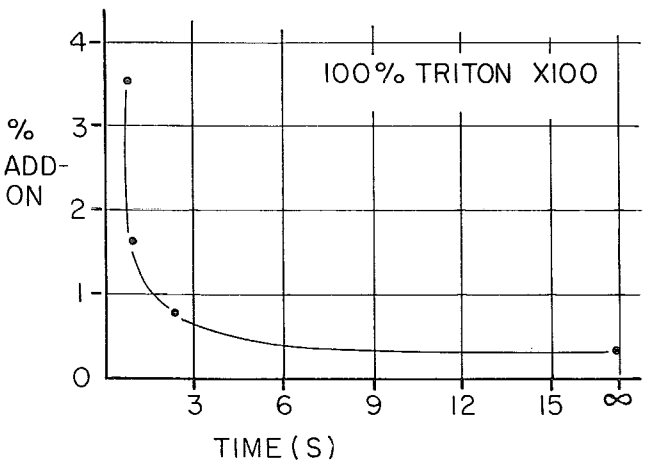
FIGS. 1 through 4 illustrate wettability determinations for various ratios of the surfactants Triton X-100 and Aerosol OT-75 (75% solids) ranging from 100% Triton X-100 to 75% Aerosol OT-75.
Figure 2:
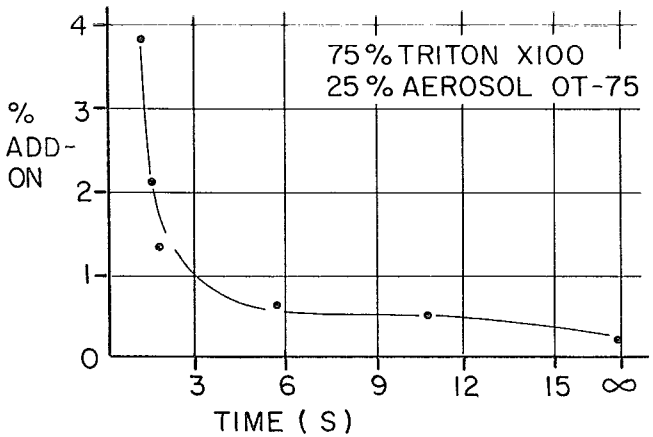
Figure 3:
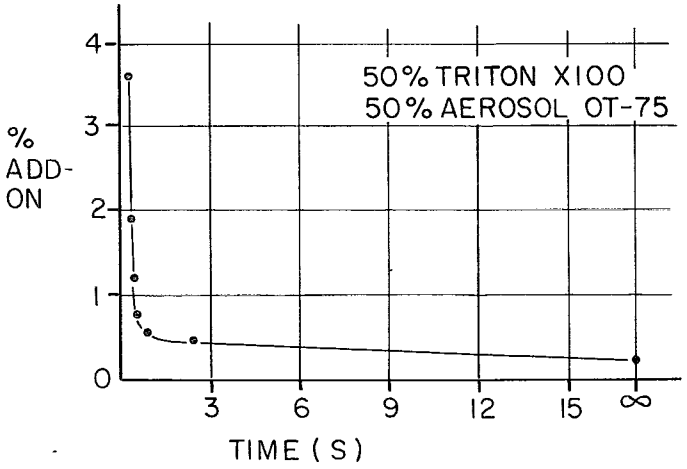
Figure 4:
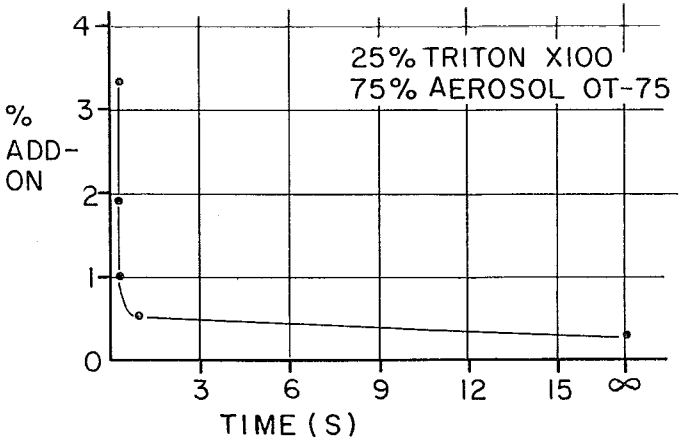
Figure 5:
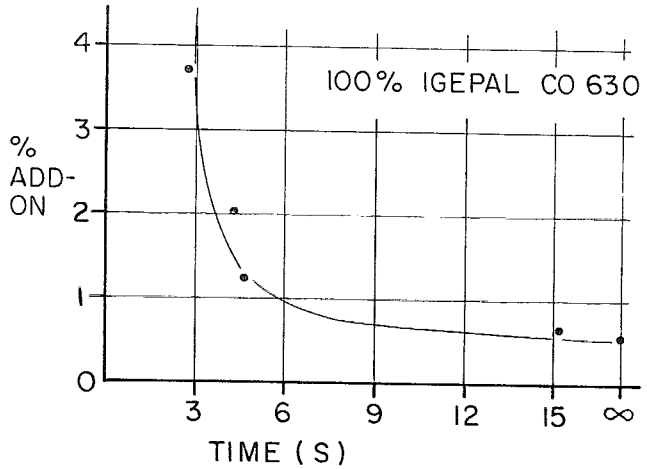
FIGS. 5 through 8 illustrate in similar fashion for comparative purposes, ratios including a different nonionic surfactant, Igepal CO630 (nonylphenoxypoly (ethyleneoxy) ethanol).
Figure 6:
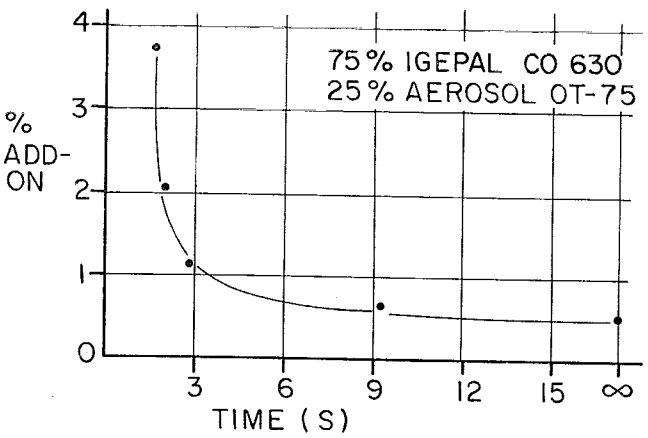
Figure 7:
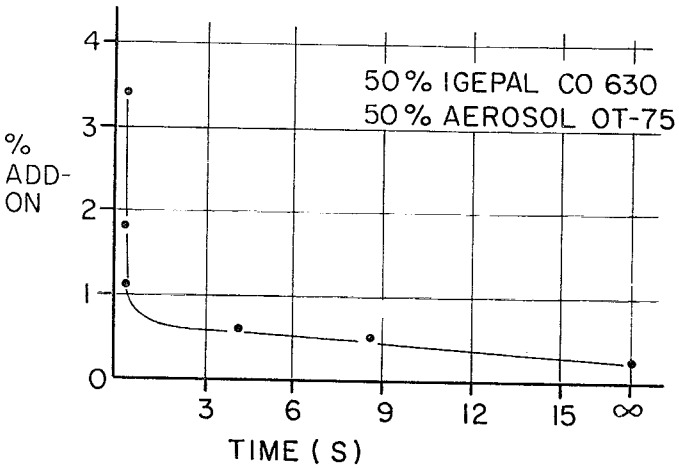
Figure 8:
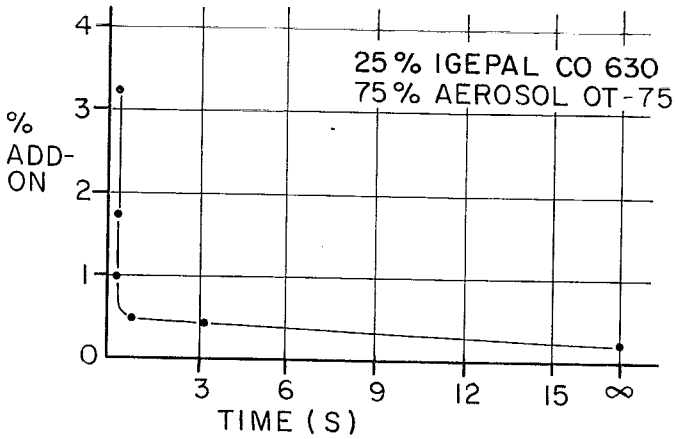
Figure 9:
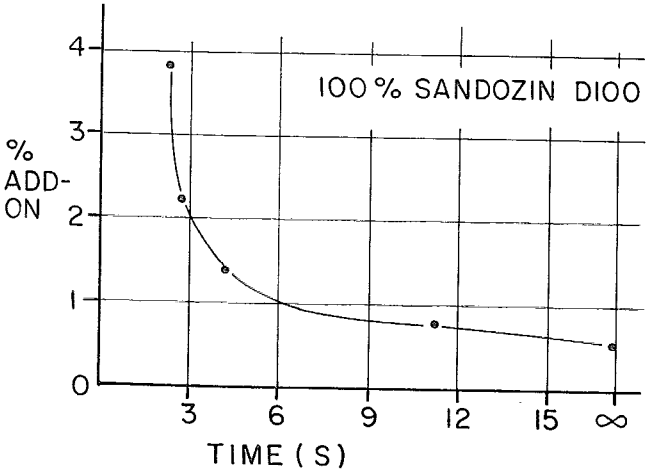
FIGS. 9 through 12 illustrate a similar comparison using Sandozin D-100 (alkyphenol polyglycolether) as the nonionic surfactant component.
Figure 10:
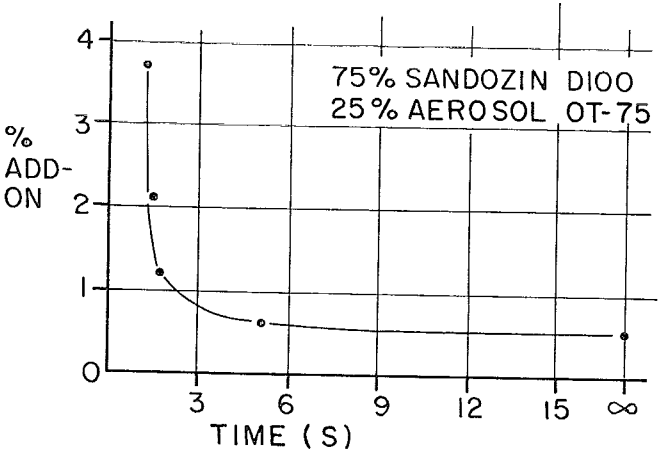
Figure 11:
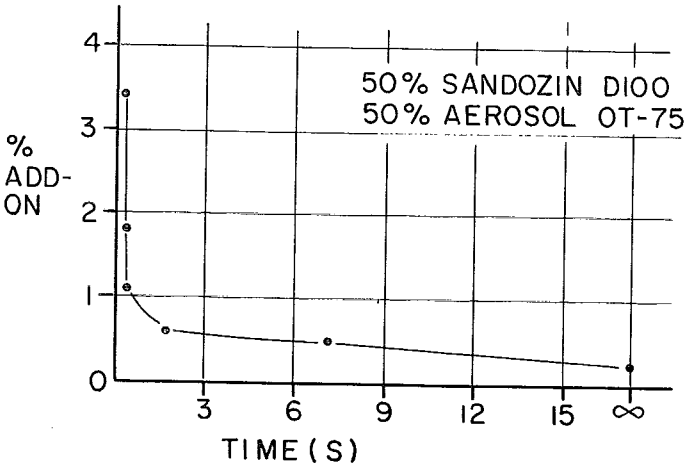
Figure 12:
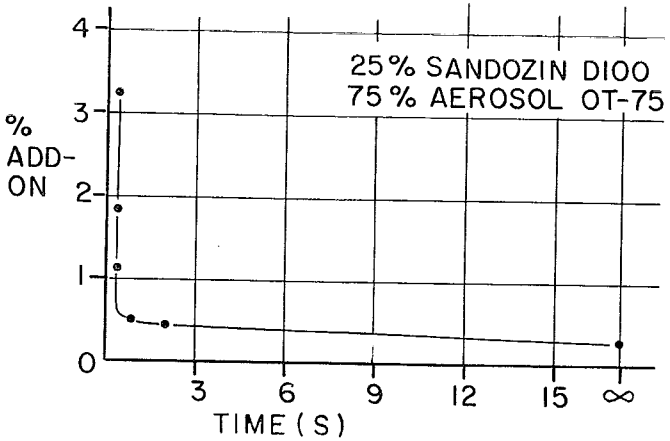

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

In connection with this description certain test procedures have been employed to determine wettability and linting characteristics. Wettability determinations were made by filling a pan with distilled water to a depth of at least one inch. A four inch by four inch square of the material to be tested was placed carefully on the surface of the water and the time was measured for about 90% of the upper surface of the material to be wetted by strike through. Visual observation was employed.

Lint tests were carried out using a Climet ® particle counter. This test also employed a mechanical particle generator which applies bending, twisting, and crushing forces to sample specimens. Samples measuring six inches by six inches are placed in position in a one cubic foot enclosure. A bottom holder raises four inches and simultaneously 180° then returns to the start position with the cycle completed in slightly less than one second. The enslosure is connected by tubing to the particle counter which draws the particles at 20 CFH. Each count takes 37 seconds and represents the number of particles 10 microns or larger in 0.01 cubic feet of air.

Sodium ion concentrations were determined by extraction of all hot water soluble materials from a sample of wiper material. These were then subjected to atomic absorption spectroscopy using a Model 305 Perkins Elmer Atomic Absorption Spectrophotometer.

The substrate material for the wiper of the present invention is not critical, and many synthetic fibrous webs may be employed. For cost purposes, nonwovens made by spinning or meltblowing thermoplastic polyolefin materials such as polypropylene and polyethylene are preferred. Most preferred for clean wiping and absorbency properties are meltblown polypropylene materials described, for example, in U.S. Pat. No. 3,959,421 dated May 25, 1976 to Weber et al. Such materials are composed of microfibers having an average diameter of generally 10 microns or less and, when treated for wettability, are very effective in absorbing both aqueous and oily materials. In general, the substrate material will have a basis weight in the range of from 0.25 oz/yd$^2$ (8.5 g/m$^2$) to 6 oz/yd$^2$ (204 g/m$^2$), preferably 0.4 oz/yd$^2$ (13.6 g/m$^2$) to 3 oz/yd$^2$ (102 g/m$^2$) and will be bonded to provide strength properties of at least about 4 lbs/oz (64 g/g) MD grab tensile and sufficient for the intended wiping purpose. Tensile results were obtained essentially in accordance with ASTM D-1117-74. Samples 4 inches by 6 inches are prepared with 5 each having its length in the "machine" and "cross" directions. An Instron machine is used having one jaw face 1 inch square and the other 1 inch by 2 inches or larger with the longer dimension perpendicular to the direction of load. At a crosshead speed of 12 inches per minute, the full scale load was recorded and multiplied by a factor as follows: Readings (lbs.): 2, 5, 10, 20, 50; factors (respectively): 0.0048, 0.012, 0.024, 0.048, 0.120. The results were reported in units of force (e.g. lbs.) required to break the sheet. Bonding may be achieved by any of the conventional means such as patterned application of heat and pressure, needling, adhesives, or utilizing the thermoplastic properties of the filaments themselves.

The method of incorporating the surfactant mixture in accordance with the invention is not critical. Thus, the surfactant mixture can be added by conventional techniques such as spraying, dipping, coating, impregnating, and printing. In general, the amount of the mixture added will be dictated by the ratio of the components, the permissible sodium ion content level, and the degree of wettability desired. For most applications this will result in addition of the surfactant mixture in the range of from about 0.2% to 0.7% by weight based on the weight of the nonwoven substrate, and preferably within the range of from 0.3% to 0.5%. For cost and performance reasons, the surfactant mixture is preferably added by means of the quench spray described in the above-mentioned Weber et al U.S. Pat. No. 3,959,421 dated May 25, 1976.

Figure 13:
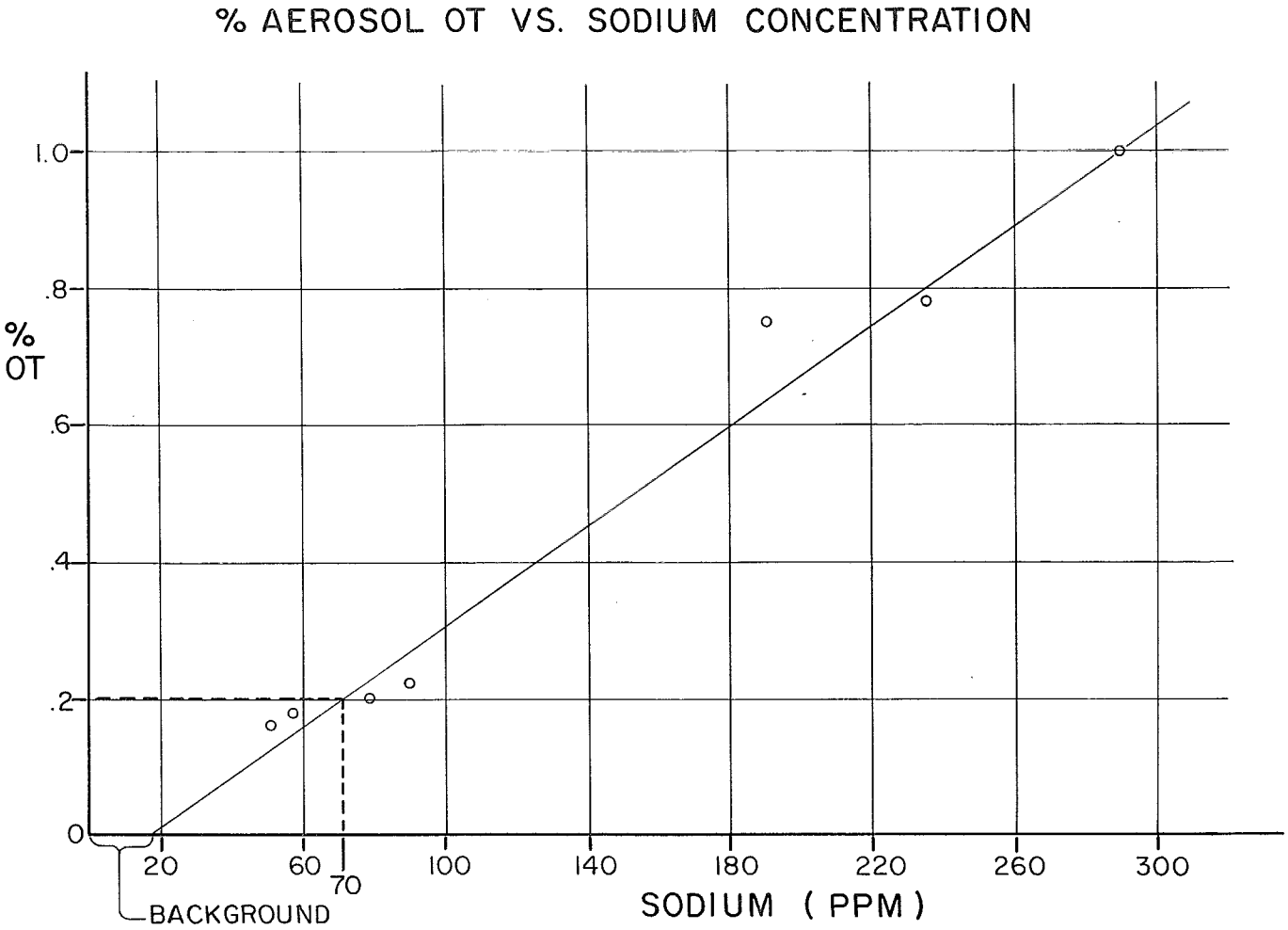
FIG. 13 is a graph illustrating the increase in sodium ion content in parts per million resulting from the addition of Aerosol OT.

The ratio of the surfactant mixture components must be within certain limits to achieve the benefits of the present invention. The maximum amount of sodium dioctyl sulfosuccinate will be determined by the permissible level of sodium ion content in the wiper. In general, for clean room applications such as the manufacture of micro-electronic devices, sodium ion content should not exceed 70 parts per million and, preferably, is less than 60 parts per million. In accordance with FIG. 13, this dictates a percentage add-on by weight of Aerosol OT-75 in the wiper of up to 0.20 and preferably 0.16 or less. To obtain most effective wiping properties, a wettability as determined by sink time of less than 5 seconds and, preferably, less than 3 seconds, is needed.

Turning to FIGS. 1 through 4, it can be seen that the use of 25% Aerosol OT-75 in the mixture requires a percent add-on of nearly one percent to achieve a sink time of 3 seconds. In contrast, a 50/50 ratio requires less than ½ percent add-on as does a ratio of 25% Triton X-100 and 75% Aerosol OT-75. However, at the 75% Aerosol OT-75 level, the sodium ion addition would be in excess of the preferred level. Accordingly, the amount of Aerosol OT-75 in the mixture in accordance with the present invention is within the range of 25 to 75% and preferably, within the range of 40 to 60%; ideally, the components are included in about equal proportions.

EXAMPLES 1–4

A series of wiper materials was prepared at varying levels of add-on using the following surfactant composition: 100% Triton X-100, 75% Triton X-100 and 25% Aerosol OT-75 (75% solids), 50% Triton X-100 and 50% Aerosol OT-75, and 25% Triton X-100 and 75% Aerosol OT-75. The substrate was a meltblown nonwoven as generally described in U.S. Pat. No. 3,959,421 dated May 25, 1976 to Weber et al and having a basis weight of 85 g/m$^2$. These materials were tested for wettability by the sink time method, and the results are illustrated in FIGS. 1 through 4.

EXAMPLES 5–8

For comparative purposes, the meltblown nonwoven material from Examples 1–4 were similarly treated with the following surfactant compositions: 100% Sandozin D-100, 75% Sandozin D-100 and 25% Aerosol OT-75, 50% Sandozin D-100 and 50% Aerosol OT-75, and 25% Sandozin D-100 and 75% Aerosol OT-75. These materials were also tested for wettability by the sink time method, and the results are shown in FIGS. 5–8.

EXAMPLES 9–12

The meltblown nonwoven material of Examples 1–4 was treated for comparative purposes with the following surfactant compositions: 100% Igepal CO630, 75% Igepal CO630 and 25% Aerosol OT-75, 50% Igepal CO630 and 50% Aerosol OT-75, and 25% Igepal CO630 and 75% Aerosol OT-75. The materials were tested for wettability by the sink time method and the results are shown in FIGS. 9–12.

To further illustrate the present invention, the material of Examples 1–4 was treated with various add-on levels of Aerosol OT-75, alone and Triton X-100 alone. Wettability tests by the sink time method were performed, and the results are shown in Table I. Also included for comparison are the results obtained with the 50/50 mixture of the present invention. As can be seen, the wettability results obtained with the mixture are nearly equal to those obtained with Aerosol OT-75, alone, and much better than those obtained with Triton X-100, alone, at the higher add-on percentage levels.

TABLE I

| Total Add-On % | Time(s) If All Aerosol OT-75 | If All Triton X-100 | If ½ Aerosol OT-75 | Experimental 50/50 Mixture |
|---|---|---|---|---|
| 3.0 | 0.3 | 0.75 | 0.3 | .4 |
| 2.0 | 0.3 | 0.75 | 0.3 | .4 |
| 1.0 | 0.3 | 1.7 | 0.9 | .45 |
| 0.75 | 0.6 | 2.4 | 1.3 | .6 |
| 0.5 | 0.9 | 4.1 | 4.0 | 1.2 |
| 0.4 | 1.2 | 5.6 | 5.0 | 4.2 |
| 0.3 | 3.3 | >120 | >120 | 10.5 |
| 0.25 | 4.0 | >120 | >120 | >120 |

For comparative purposes, Table II below lists the results of lint tests performed on the preferred wiper of the present invention including the mixture of 50/50 Triton X-100 and Aerosol OT-75 along with various commercially available wiping materials including those used for clean room applications. Also included are measurements of sodium ion content. Wiper A is a conventional meltblown, treated wiper. Wiper B is representative of a clean room long fiber cellulose wipe. Wiper C is a dry creped tissue wipe. Wiper D is a woven cloth wiper intended for clean room use. Wiper E is a thermally bonded polypropylene carded web. As can be seen, the wiper of the present invention is unique among those tested in providing both low metallic ion content and low lint results. The exception to this is Wiper E which has low wettability and poor wiping properties and, therefore, not readily adaptable for clean room applications.

TABLE II

| | PPM $NA^+$ | | Lint Particles <10 Microns | <0.5 Microns | | | |
|---|---|---|---|---|---|---|---|
| | Hot Water | Cold Water | 1 Cycle | 2 Cycles | 3 Cycles | 4 Cycles | 5 Cycles |
| Wiper A | 161.7 | 104.9 | .4 | 98 | 155 | 213 | 290 |
| Wiper B | 141.0 | 133.7 | .4 | 978 | 1688 | 2115 | 2444 |
| Wiper C | 104.8 | 96.0 | 0.6 | 2185 | 3774 | 5134 | 6179 |
| Wiper D | 31.4 | 22.7 | 5.0 | 406 | 441 | 448 | 393 |
| Wiper E | 3.9 | 4.0 | 1.4 | 29 | 35 | 25 | 24 |
| Wiper of The Present Invention | 60.0 | 40.0 | 4.0 | 135 | 214 | 285 | 418 |

Thus, it is apparent that there has been provided in accordance with the invention, an improved, low lint nonwoven wiper that contains reduced metallic ion levels and fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

We claim:

1. A wiper comprising a nonwoven substrate having a basis weight in the range of from 0.25 oz/yd$^2$ to 6 oz/yd$^2$ and comprising treated, hydrophobic, thermoplastic fibers, said substrate containing 0.2 to 0.7% by weight of sodium dioctyl sulfosuccinate and a nonionic surfactant as a mixture containing 25 to 75% by weight of sodium dioctyl sulfosuccinate, said wiper having a sodium ion content of less than 100 parts per million and a wettability as determined by the sink time method of less than 5 seconds.

2. The wiper of claim 1 wherein said thermoplastic fibers are polypropylene.

3. The wiper of claim 2 wherein said thermoplastic fibers are meltblown.

4. The wiper of claim 1 wherein said nonionic surfactant is an alkyl phenoxy ethanol.

5. The wiper of claim 3 wherein said nonionic surfactant is an alkyl phenoxy ethanol.

6. The wiper of claim 5 wherein said mixture contains 40 to 60% by weight sodium dioctyl sulfosuccinate.

7. The wiper of claim 6 wherein said mixture contains about equal proportions of sodium dioctyl sulfosuccinate and an alkyl phenoxy ethanol.

8. The wiper of claim 7 wherein the basis weight is in the range of from 0.4 oz/yd$^2$ to 3 oz/yd$^2$.

9. The wiper of claim 8 wherein the substrate contains 0.3 to 0.5% of the surfactant mixture.

10. The wiper of claim 9 wherein the wettability is less than 3 seconds.

11. A wiper comprising a meltblown, polypropylene substrate having an average fiber diameter in the range of up to about 10 microns and a basis weight in the range of from about 0.4 oz/yd$^2$ to 3 oz/yd$^2$, said substrate containing 0.3 to 0.5% by weight of a surfactant mixture containing sodium dioctyl sulfosuccinate and an alkyl phenoxy ethanol wherein said sodium dioctyl sulfosuccinate is present in an amount of 40 to 60%, said wiper having a sodium ion content of less than 77 PPM and wettability of less than 3 seconds.

12. The wiper of claim 11 wherein said sodium dioctyl sulfosuccinate and said alkyl phenoxy ethanol are present in said mixture in substantially equal proportions.

* * * * *